US007118057B2

(12) United States Patent
Hao

(10) Patent No.: US 7,118,057 B2
(45) Date of Patent: Oct. 10, 2006

(54) HORIZONTAL ROLLER MILL

(76) Inventor: Zhigang Hao, 3-402, Hong Yuan Xiao Qu, No. 39, Cheng Nan Zhong Rd., Changsha City, Huana Province (410007) (CN)

( * ) Notice: Subject to any disclaimer, the term of this patent is extended or adjusted under 35 U.S.C. 154(b) by 146 days.

(21) Appl. No.: 10/801,806

(22) Filed: Mar. 16, 2004

(65) Prior Publication Data

US 2004/0206835 A1 Oct. 21, 2004

(30) Foreign Application Priority Data

Sep. 17, 2001 (CN) ..... 01 1 28599

(51) Int. Cl.
*B02C 23/00* (2006.01)
*B02C 1/08* (2006.01)

(52) U.S. Cl. ..... 241/228; 241/252

(58) Field of Classification Search ..... 241/252, 241/259.1, 259.2, 261.1, 259.3, 228, 117, 241/121, 227, 244, 245, 107
See application file for complete search history.

(56) References Cited

U.S. PATENT DOCUMENTS 1,718,184 A * 6/1929 Ostermann ..... 241/18
1,719,979 A * 7/1929 Ihlefeldt ..... 241/108
2,258,392 A * 10/1941 Piper ..... 241/143
2,274,502 A * 2/1942 Piper ..... 241/119
2,644,643 A * 7/1953 Frisch et al. ..... 241/122
4,527,748 A * 7/1985 Catani ..... 241/57
5,205,494 A * 4/1993 Durinck et al. ..... 241/30
5,743,475 A * 4/1998 Catani ..... 241/57
6,138,933 A * 10/2000 Chevalier et al. ..... 241/261.1

FOREIGN PATENT DOCUMENTS

| | | |
|---|---|---|
| CN | 94226768.0 | 11/1994 |
| CN | 94192971.X | 3/1999 |
| CN | 97247737.3 | 8/1999 |
| EP | 0 486 371 A2 | 5/1992 |

* cited by examiner

*Primary Examiner*—Faye Francis
(74) *Attorney, Agent, or Firm*—Hanley, Flight & Zimmerman, LLC

(57) ABSTRACT

A horizontal roller mill to increase production yield. An example horizontal roller mill includes a cylinder and rollers. Each end of the cylinder includes an end cover, the end cover of one end includes an inlet and an end cover of the other end includes an outlet port. An outer wall surface of the cylinder includes a driving member for rotating the cylinder, the roller being located within the cylinder. Axial sections at both ends of the roller extend out of the end covers of the cylinder. The extended axial sections are provided with a mechanism for adjusting the material grinding pressure and for adjusting the gap between the surface of the roller and the inner wall surface of the cylinder. The example roller mill includes scrapers configured to scrape material layers. Further, at least two of the rollers are distributed along the circumference of an inner cavity of the cylinder. The example roller mill also includes a support system configured to restrict the cylinder in the circumferential direction.

6 Claims, 3 Drawing Sheets

HORIZONTAL ROLLER MILL

RELATED APPLICATION

This application claims priority from International Patent Application No. PCT/CN02/00645 filed on Sep. 13, 2002.

FIELD OF THE DISCLOSURE

The present disclosure relates generally to material grinding equipment and, more particularly, to a horizontal roller mill.

BACKGROUND

Patent No. 972477373.3 published on Aug. 25, 1999 discloses a roller mill having a cylinder, a support system supporting an outer wall surface at a lower portion of the cylinder, and a roller. The roller includes an inlet means on an end cover at one end of the cylinder and an outlet port on an outlet hood at the other end of the cylinder. The roller is located within the cylinder so that the surface of the roller and the lower surface of an inner cavity of the cylinder form a material grinding surface. Axle sections at both ends of the roller extend out of the end covers and outlet hoods of the end portions of the roller. Each of the extended axle sections is coupled to a mechanism for applying pressure (e.g., a hydraulic cylinder) to adjust a material grinding pressure. The cylinder is provided on its outer wall surface with a driving member (e.g., a gear) for rotating the cylinder. In addition, a baffle plate is disposed at the upper left of the rotating direction of the cylinder.

While the roller mill disclosed in the above-referenced patent has some advantages, it has a relatively low production yield because it has only one roller. To increase production yield with a roller mill such as that described above, a high revolution speed is needed. However, because the support system only supports the outer wall surface at the lower portion of the cylinder, the support system restricts movement of the cylinder in a vertically downward direction. As for other directions along the circumference, especially the upward direction, the system remain in a free state. Thus, during operation, when an intermediate or a high speed is used, the cylinder body exhibits radial runout or vibration, resulting in poor stability and undesirable noise during operation. In addition, when the pressure mechanism drives the roller toward the material for grinding, the force produced due to pressure and acted upon the cylinder is completely downward, causing various parts of the equipment to withstand an uneven force. Furthermore, the force due to pressure, transmitted via the cylinder, will act completely on the support system and, thus, will affect the normal operation of the support system, and excess pressure will aggravate the wear of the member and even cause partial members to be damaged.

DETAILED DESCRIPTION

Figure 1:
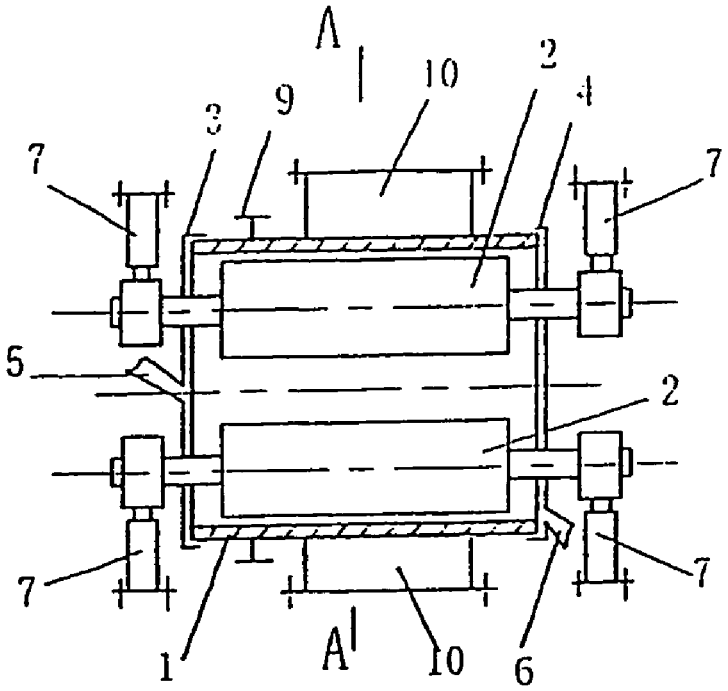
FIG. 1 is a front view of an example roller mill.

An example roller mill described in greater detail below includes a cylinder and rollers. Each end of the cylinders is provided with an end cover. One of the end covers includes an inlet means and the other end cover includes an outlet port. The cylinder is provided on its outer wall surface with a driving member for driving the cylinder to rotate. The roller is located within the cylinder so that axial sections (e.g., axels) at both ends of the roller extend out of the end covers of the cylinder. Each of the extended axial sections is coupled to a pressure applying mechanism for adjusting the material grinding pressure and the gap between the roller surface and the inner wall surface of the cylinder. The mill has at least two rollers, which are distributed along the circumferential direction of the inner cavity of the cylinder. The surface of each roller forms a material grinding surface against the inner cavity of the cylinder. The mill is also provided with a support system for restricting the cylinder in the circumferential direction and scrapers with respect to the material layer. Alternatively, at least two rollers may be distributed uniformly along the circumferential direction of the inner cavity of the cylinder.

The example roller mill may include a support system for restricting the cylinder in the circumferential direction, and at least two rollers distributed or uniformly distributed along the circumferential direction of the inner cavity of the cylinder.

The example roller mill may use one or more rollers operating simultaneously to increase production yield. In addition, the example roller mill may include a support system that restricts the cylinder in the circumferential direction so that during intermediate or high speed operation, the support system can effectively prevent radial runout of the cylinder or vibration during operation, thereby ensuring good stability during operation, and reducing notably the noise and damage due to vibration. Still further, because two or more rollers may be distributed or distributed uniformly along the circumferential direction of the inner cavity of the cylinder, when the roller operates under normal pressure or increased pressure, the equipment is uniformly and equally pressurized at various parts due to the rigidity construction of the cylinder itself when various forces act upon it, and no adverse effect is produced to the normal operation of other members connected to the cylinder. Still further, the pressure of the roller may not act upon the support system, thereby reducing the friction between the roller and the support system, reducing power consumption, and ensuring better stability and reliability. Still further, at least two rollers are disposed within the cylinder, and the support system acts to restrict the cylinder in the circumferential direction, which enables production yields to be effectively increased by adding revolutions. While increasing production yield, the pressure of the roller can be appropriately reduced to minimize the wear and damage of the members, thereby ensuring a longer life of the members and improving the reliability of operation. In addition, such high speed operation facilitates processing of super-fine powders.

Figure 2:
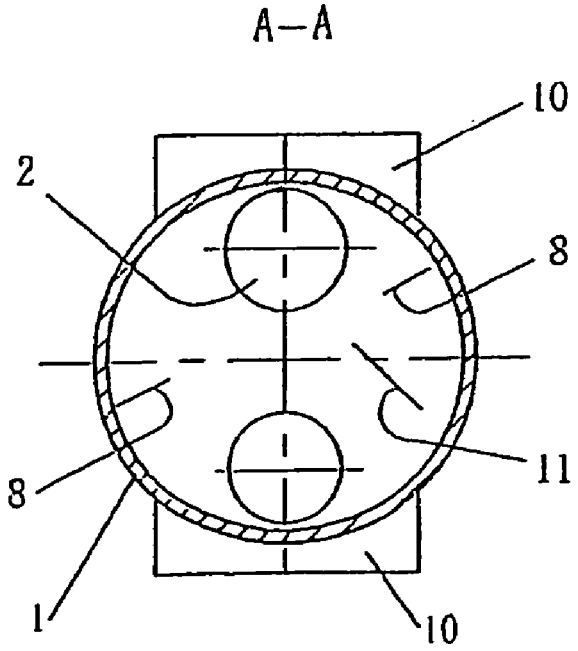
FIG. 2 is a cross-sectional view of the example roller mill of FIG. 1.

FIGS. 1 and 2 depict an example roller mill comprising a cylinder 1, rollers 2 located within the cylinder 1 and arranged symmetrically up and down. The cylinder 1 is provided at both ends with end covers 3 and 4. The end cover 3 includes an inlet means 5 and the end cover 4 includes an outlet port 6. The surface of each of the rollers 2 and the corresponding wall surface of the inner cavity of the cylinder 1 form a material grinding surface. The axial sections at both ends of each roller extend out of the end covers 3 and 4 at both ends of the cylinder 1. The extended axial sections (e.g., axels) are each provided with a pressure applying mechanism 7 for adjusting the material grinding pressure and the gap between the roller surfaces and the inner wall surface of the cylinder 1 (i.e., the size of the gap of the material grinding surface) by means of a rolling bearing. Between neighboring rollers is provided a scraper 8, which plays a part of loosing and axially transporting the material layers (e.g., the ground material). The scraper 8 is connected to the end cover via a hinged connecting rod, and the gap between the scraper 8 and the inner cavity wall surface of the cylinder is adjustable. An outer wall surface of the cylinder 1 is provided with a driving member 9 for rotating the cylinder 1. The driving member 9 may be a gear member or a driving member of any other suitable type. The driving input may cause the cylinder 1 to rotate, and the roller 2 will rotate accordingly to grind the material. A support system 10 is provided for restricting the cylinder 1 in the circumferential direction, as shown in FIG. 2, two independent support systems are arranged symmetrically up and down along the circumferential direction on the outer wall of the cylinder 1. The support system 10 may be of sliding bearing-type structure and may also may be implemented using a riding wheel or other support structure, which plays a part of radial restriction to the cylinder along the circumferential direction. Such radial restriction may be used to effectively prevent the cylinder 1 from radial runout or vibration during operation, thereby resulting in good stability, reduced vibration and low noise. The example roller mill described above can be used to meet the requirement of intermediate and high-speed operation to increase production yield. The end cover, pressure mechanism and support system 10 may be fixed on the frame, and may also be connected directly to a specially set prefab.

In addition, a guiding means 11 may be disposed under the scraper 8 at the upper portion of the inner cavity of the cylinder 1. The tilt angle of the guiding means may be adjustable to control the speed of the material flow, and the guiding means may be connected to the end cover via a hinged connecting rod.

Figure 3:
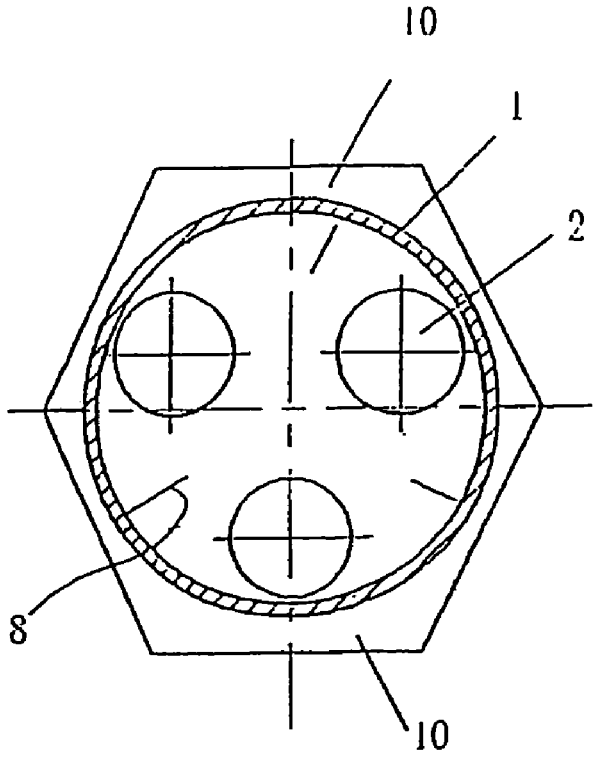
FIG. 3 is a cross-sectional view of another example roller mill.

FIG. 3 shows a cross-sectional view of another example roller mill. In the example of FIG. 3, three rollers 2 are distributed uniformly along the circumferential direction in the inner cavity of cylinder 1 and the support system 10 is arranged along the outer wall surface of the cylinder 1 for restriction.

Figure 4:
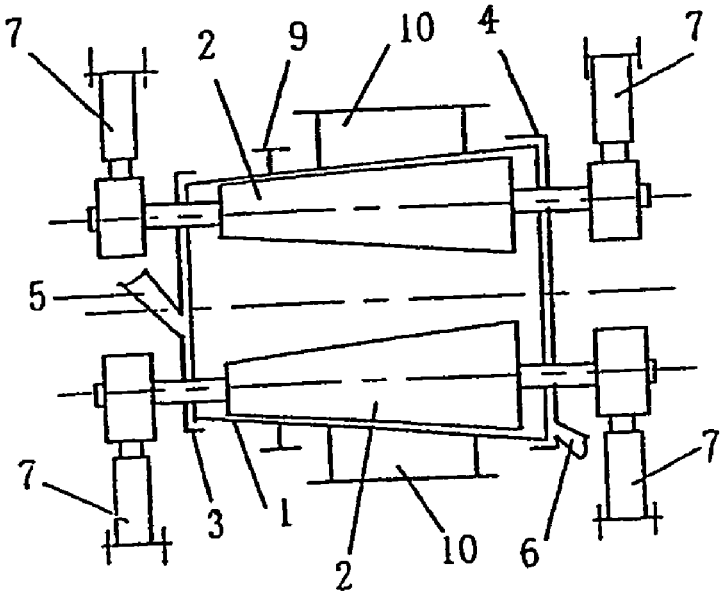
FIG. 4 is a front view of an another example roller mill.

FIG. 4 is a front view of another example roller mill. The cylinder 1 is modified to be a conical cylinder, the roller 2 is modified to be a conical roller, the surface of the conical roller corresponding to the inner wall surface of the cylinder. The material is put in from the inlet means 5 of a smaller port of the conical cylinder, and flows toward the outlet port 6 of a larger port during grinding operation. The inner wall of the conical cylinder can produce an axial component of force enabling the material to slide forward so as to reduce the wear of, and force upon, the scraper.

Figure 5:
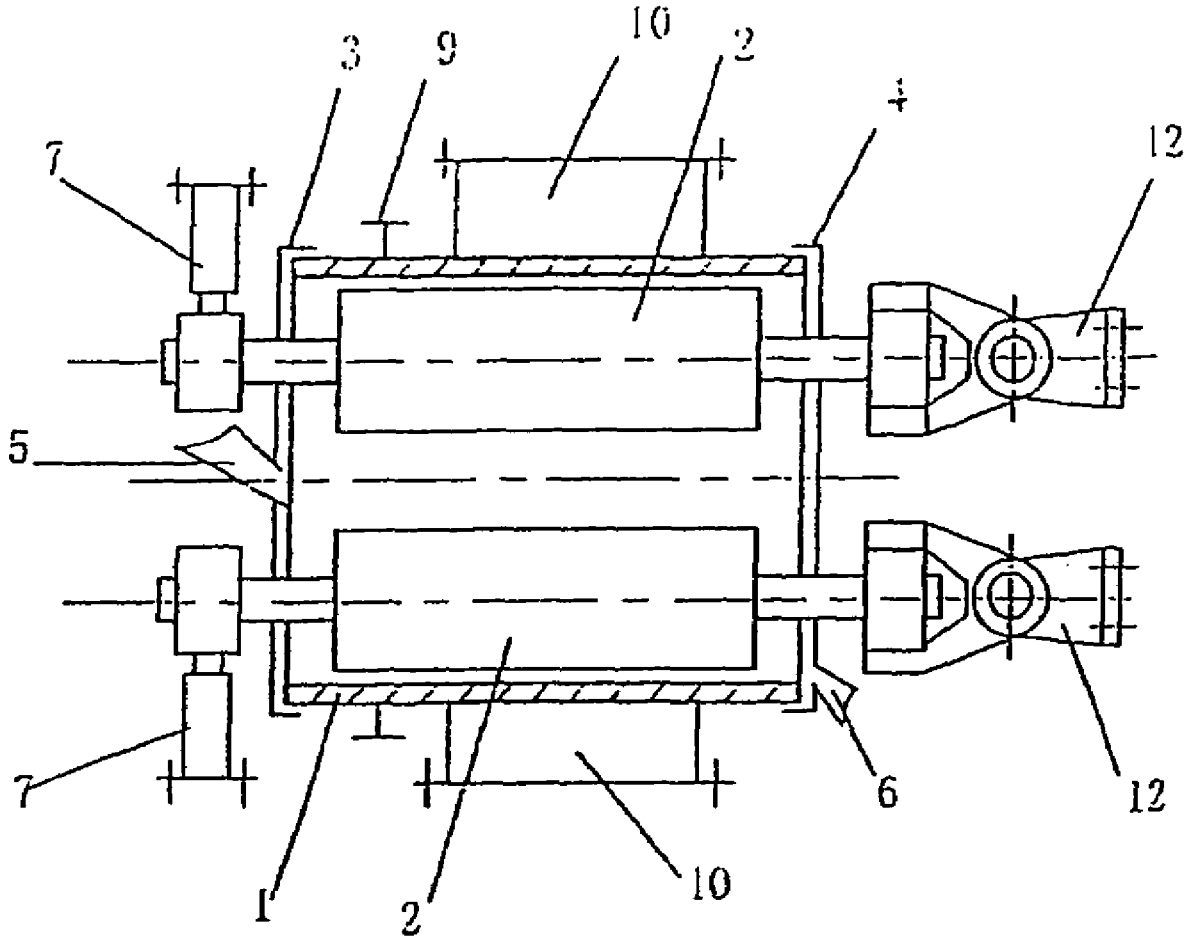
FIG. 5 is a front view of another example roller mill.

FIG. 5 is a front view of another example roller mill. The axial section of either end of the roller is provided with a pressure applying mechanism 7, and the axial section of the other end thereof is connected to a hinged seat 12 via a rolling bearing. The roller 2 can achieve a pressurized grinding to the material by the action of the pressurized mechanism on one end of the roller 2.

Although certain methods and apparatus have been described herein, the scope of coverage of this patent is not limited thereto. To the contrary, this patent covers all embodiments fairly falling within the scope of the appended claims either literally or under the doctrine of equivalents.

What is claimed is:

1. A horizontal roller mill comprising a cylinder and rollers, both ends of said cylinder each being provided with an end cover, the end cover of one end being provided with an inlet, the end cover of the other end being provided with an outlet port, on the outer wall surface of said cylinder is disposed a driving member for rotating the cylinder, the rollers being located within the cylinder and having two axial sections, the axial sections at both ends of the rollers extending out of the end covers of the cylinder, on the two extended axial sections being provided with a mechanism for adjusting the material grinding pressure and for adjusting the gap between the surface of the rollers and the inner wall surface of the cylinder, and there being provided scrapers configured to scrape material layers, wherein at least two of the rollers are distributed along the circumference of an inner cavity of the cylinder, and a support system having a first support structure configured to restrict the cylinder in the downward circumferential direction and a second support structure configured to restrict the cylinder in the upward circumferential direction.

2. A horizontal roller mill according to claim 1, wherein the at least two rollers are distributed uniformly along the circumference of the inner cavity of the cylinder.

3. A horizontal roller mill according to claim 1, wherein the cylinder is a conical cylinder, and at least one of the rollers is a conical roller, and a surface of the conical roller corresponds to the inner wall surface of the cylinder.

4. A horizontal roller mill according to claim 1, wherein the scrapers are disposed between adjacent ones of the rollers.

5. A horizontal roller mill according to claim 1, further comprising a guide arranged under each of the scrapers at an upper portion of the inner cavity of the cylinder, and wherein a tilt angle of the guide is adjustable.

6. A horizontal roller mill according to claim 1, further comprising a pressure applying mechanism coupled to an axial section of one end of the cylinder and configured to vary a material grinding pressure and a gap between the surface of the rollers and the inner wall surface of the cylinder, wherein the axial section of the other end is connected to a hinged seat.

* * * * *